US009388696B2

(12) United States Patent
Celotta et al.

(10) Patent No.: US 9,388,696 B2
(45) Date of Patent: Jul. 12, 2016

(54) REMOVABLE SHIM CLIP FOR ADJUSTABLE PISTON PUMP

(75) Inventors: Daniel W. Celotta, Circle Pines, MN (US); John C. Holman, Ham Lake, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 780 days.

(21) Appl. No.: 13/698,943

(22) PCT Filed: May 19, 2011

(86) PCT No.: PCT/US2011/000893

§ 371 (c)(1),
(2), (4) Date: Nov. 19, 2012

(87) PCT Pub. No.: WO2011/146125

PCT Pub. Date: Nov. 24, 2011

(65) Prior Publication Data

US 2013/0061745 A1 Mar. 14, 2013

Related U.S. Application Data

(60) Provisional application No. 61/346,287, filed on May 19, 2010.

(51) Int. Cl.
*F01B 31/14* (2006.01)
*F01B 29/00* (2006.01)
(Continued)

(52) U.S. Cl.
CPC ..... *F01B 29/00* (2013.01); *F04B 1/0421* (2013.01); *F04B 9/042* (2013.01); *F04B 53/16* (2013.01); *F04B 53/162* (2013.01); *F04B 53/168* (2013.01)

(58) Field of Classification Search
CPC ..... F04B 9/42; F04B 53/14
USPC ..... 92/60.5
See application file for complete search history.

(56) References Cited

U.S. PATENT DOCUMENTS 3,689,199 A 9/1972 Bassinger
3,849,032 A 11/1974 Mulvey et al.
(Continued)

FOREIGN PATENT DOCUMENTS

CN 101165344 A 4/2008
DE 3308697 A1 9/1984
(Continued)

OTHER PUBLICATIONS

Paul67, Installing Shims on Offset Trailing arms, Aug. 12, 2006, can be found at <http://www.corvetteactioncenter.com/forums/c1-and-c2-general-and-technical-discussion/86939-installing-shims-offset-trailing-arms.html>.*
Chinese Office Action from CN Application Serial No. 201180024803.5, dated Oct. 30, 2014, 16 pages.
(Continued)

*Primary Examiner* — Nathaniel Wiehe
*Assistant Examiner* — Daniel Collins
(74) *Attorney, Agent, or Firm* — Kinney & Lange, P.A.

(57) ABSTRACT

A pump assembly comprises a base, a cam, a cylinder, a piston, and a shim clip. The cam rotates about a rotational axis with respect to the base. The cylinder attaches to the base, and has an inlet port and an outlet for fluid. The piston is reciprocally driven by rotation of the cam to draw fluid into the cylinder through the inlet port during a fill stroke, and to close the inlet port and pump fluid in the cylinder toward the offset during a pump stroke. The shim clip is removably insertable between the cylinder and the base to increase the distance between the inlet port and the rotational axis.

18 Claims, 3 Drawing Sheets

(51) Int. Cl.

| | |
|---|---|
| ***F04B 1/04*** | (2006.01) |
| ***F04B 53/16*** | (2006.01) |
| ***F04B 9/04*** | (2006.01) |

(56) References Cited

U.S. PATENT DOCUMENTS

| | | | | |
|---|---|---|---|---|
| 4,620,836 | A | 11/1986 | Brandl | |
| 4,782,738 | A * | 11/1988 | Jackson et al. | 92/60.5 |
| 5,032,065 | A | 7/1991 | Yamamuro et al. | |
| 6,162,030 | A * | 12/2000 | Pierrat | 417/497 |
| 2002/0015649 | A1 | 2/2002 | Bach | |
| 2004/0101418 | A1 | 5/2004 | Roth et al. | |

FOREIGN PATENT DOCUMENTS

| | | | | |
|---|---|---|---|---|
| DE | 102006035055 | A1 | 1/2008 | |
| GB | 637173 | | 5/1950 | |
| KR | 20040065725 | A | 7/2004 | |
| SU | 676751 | A1 | 7/1979 | |
| SU | 1679051 | * | 9/1991 | F04B 53/14 |

OTHER PUBLICATIONS

International Search Report and Written Opinion for PCT Application Serial No. PCT/US2011/000893, dated Jan. 18, 2012, 6 pages.

Extended European Search Report for EP Application No. 11783868.0, dated Dec. 23, 2015, 7 pages.

* cited by examiner

REMOVABLE SHIM CLIP FOR ADJUSTABLE PISTON PUMP

BACKGROUND

The present invention relates generally to piston pumps, and more particularly to piston pumps driven by a rotating cam.

Piston pumps are commonly used to move fluids such as oil or grease in a wide range of industrial and automotive applications. Piston pumps driven by a rotating cam pump an approximately constant amount of fluid with each rotation of the cam.

Piston pumps driven by rotating cams comprise three parts: a cam, a piston coupled to the cam, and a cylinder containing the piston. Cams can be circular, elliptical, or irregularly shaped disks, but in all cases exert a force on the piston as the cam rotates. The piston of a piston pump is typically constrained to move along a straight path inside the cylinder, and is retained against an outer circumferential surface of the cam. The cylinder of a piston pump constrains the piston, and provides a pumping chamber into which fluid is drawn, and from which fluid is pumped by movement of the piston. Many pistons are substantially cylindrical shafts, and most cylinders are substantially cylindrical tubes. Piston cylinders include inlet ports which allow fluid to enter the pumping chamber. These ports are typically holes in the sides of the cylinder.

As the cam of a piston pump rotates, the piston is pushed back and forth inside the cylinder with the assistance of a spring, towards and away from the cam. The cam pushes the piston into the cylinder, and the spring returns the piston when the cam retreats. This reciprocating motion of the piston opens and closes at least one port in the piston cylinder by unblocking and blocking the port. While the piston withdraws, fluid flows through the open port into the pumping chamber of the cylinder. When the piston extends, it blocks the port and forces fluid trapped in the pumping chamber out through a pump outlet.

Cam-driven piston pumps provide constant displacement with each rotation of the cam. Some piston assemblies allow the displacement of a piston pump to be configured by swapping a cartridge containing a piston and a cylinder of one size for an alternative cartridge with a smaller or larger pump chamber, usually from a smaller or larger piston radius. Such systems enable one pump assembly to be used for a variety of desired displacement amounts, but only by manually removing one cartridge and replacing it with an alternative-displacement equivalent.

SUMMARY

The present invention is directed toward a pump assembly with a base, a cam, a cylinder, a piston, and a shim clip. The cam rotates about a rotational axis with respect to the base. The cylinder attaches to the base, and has an inlet port and an outlet for fluid. The piston is reciprocally driven by rotation of the cam to draw fluid into the cylinder through the inlet port during a fill stroke, and to close the inlet port and pump fluid in the cylinder toward the offset during a pump stroke. The shim clip is removably insertable between the cylinder and the base to increase the distance between the inlet port and the rotational axis.

DETAILED DESCRIPTION

Figure 1:
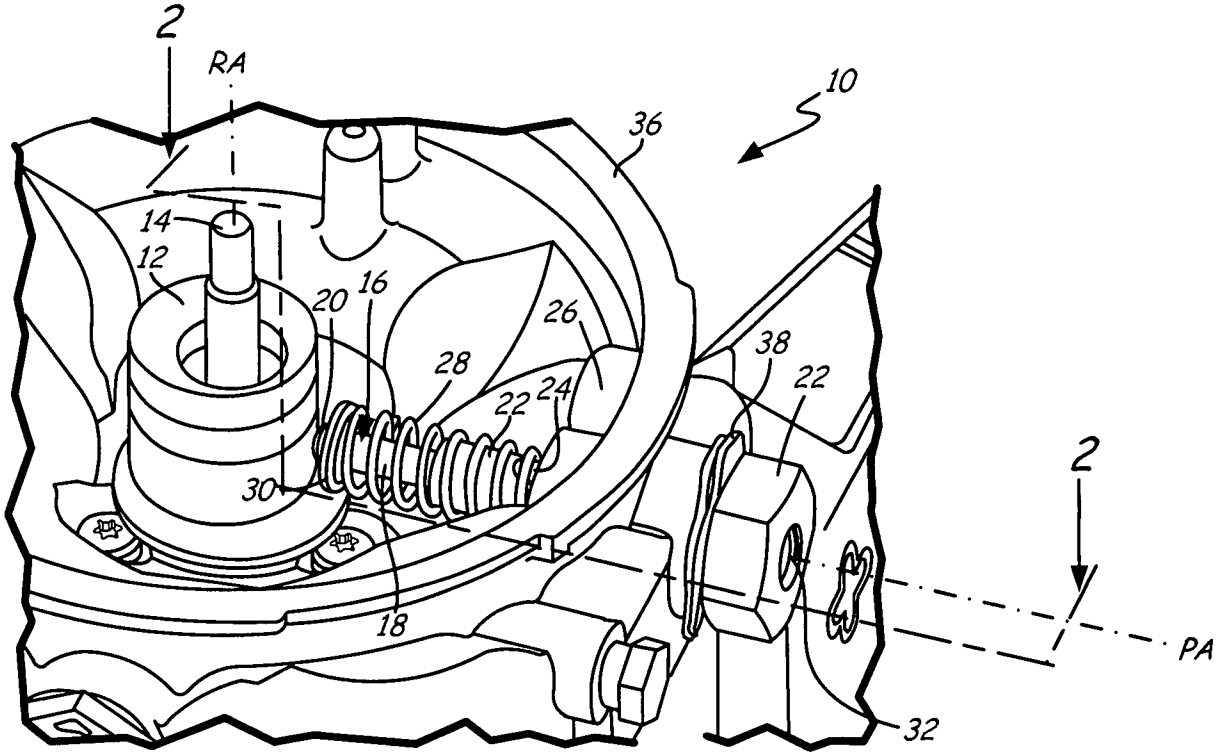
FIG. 1 is a perspective view of a pump assembly of the present invention, including a cam, a piston in contact with the cam, and a cylinder in which the piston rides.

FIG. 1 is a perspective view of pump assembly 10, comprising cam 12, driveshaft 14, piston 16 (with straight shaft 18 and cam follower 20), cylinder 22, port 24, base 26, piston spring 28, piston spring platform 30, outlet 32, reservoir attachment ring 36, and shim clips 38. Cam 12 is a disc with an outer circumferential wall and an eccentric axis of rotation, such as a circular disk with an axis of rotation offset from the geometric center of the circle. Driveshaft 14 is a rotatable shaft anchored to cam 12 through axis of rotation RA. Piston 16 is a rigid piston which rides cam 12. Piston 16 comprises straight shaft 18 and cam follower 20, which is slightly rounded. Cylinder 22 is a substantially cylindrical tube retaining piston 16 such that straight shaft 18 forms a seal with the interior of cylinder 22. Cylinder 22 features at least one port 24. As shown, port 24 is a hole through both sides of cylinder 22. Base 26 is a rigid body which anchors both driveshaft 14 and cylinder 22. In the depicted embodiment, base 26 is an injection molded plastic piece, but base 26 may generally be any structure which anchors cylinder 22 relative to driveshaft 14. Cylinder 22 is threaded into base 26. In other embodiments, cylinder 22 may be removably attached to base 26 by other means. Piston spring 28 extends between cylinder 22 and piston spring platform 30, which is a disc mounted on piston 16, near cam follower 20. Cylinder 22 includes outlet 32, an exit point for fluid such as fuel, oil, or grease. Outlet 32 has a threaded interior surface for attaching a hose or tube to carry fluid. In alternative embodiments, hoses or tubes may be attached to outlet 32 by other means. A fluid reservoir (not shown) is anchored atop pump assembly 10 at reservoir attachment ring 36. Together with base 26, this reservoir forms a space which can be filled with fluid.

Driveshaft 14 rotates under power to turn cam 12. For example, driveshaft 14 may rotate under power from an air motor or an electric motor. As cam 12 turns about eccentric axis of rotation RA, piston spring 28 retains cam follower 20 of piston 16 against the outer circumferential wall of cam 12 via spring force. As cam 12 rotates, it exerts a force on piston 16, compressing piston spring 28. As cam 12 continues to rotate, piston spring 28 keeps cam follower 20 in contact with cam 12 while the outer circumferential wall of cam 12 recedes. Straight shaft 18 of piston 16 travels back and forth along piston axis PA (see FIG. 2), through cylinder 22, driven by cam 12.

Fluid from the reservoir anchored at reservoir attachment ring 36 fills the region surrounding cam 12, piston 16, and cylinder 22. As cam 12 turns, piston 16 translates along a path defined by cylinder 22. Motion of piston 16 to the left creates a vacuum void within cylinder 22 while port 24 is closed (see FIG. 2). When port 24 opens, this vacuum draws fluid into cylinder 22 through port 24. Motion of piston 16 to the right drives fluid out of cylinder 22 via outlet 32, thereby pumping fluid out of the reservoir.

Shim clips 38 are clips of a predetermined width, and may, for instance, be formed of stamped metal. Shim clips 38 can be inserted between cylinder 22 and base 26, as shown, to adjust the position of port 24 relative to cam 12. Inserting or removing shim clips 38 alters the displacement of pump assembly 10, as described below with respect to FIG. 2. Pump assembly 10 can be used in any suitable system, such as in commercial and industrial lube systems.

Figure 2:
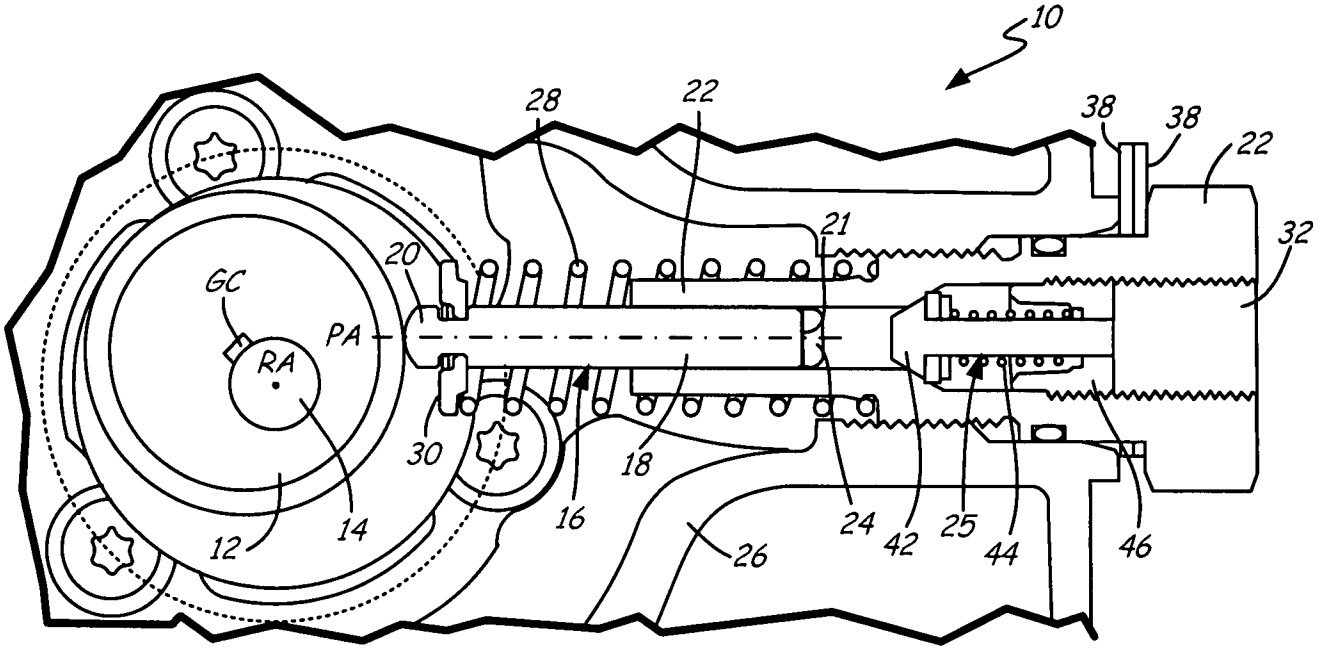
FIG. 2 is a cross-sectional view of the pump assembly of FIG. 1.

FIG. 2 is a cross-sectional view of pump assembly 10 through section line 2-2 of FIG. 1. FIG. 2 depicts cam 12, driveshaft 14, piston 16 (with straight shaft 18, cam follower 20, and piston face 21), cylinder 22, port 24, valve 25, base 26, piston spring 28, piston spring platform 30, outlet 32, shim clips 38, plug 42, valve spring 44, and valve spring platform 46. As described with respect to FIG. 1, driveshaft 14 rotates cam 12, and is anchored to base 26. Piston 16 slides within cylinder 22 and is retained against cam 12 by spring 28, reciprocating along piston axis PA. Cylinder 22 has port 24 through which fluid enters cylinder 22, and outlet 32 through which fluid exits cylinder 22. In addition, valve 25 forms a seal within cylinder 22. Valve 25 is a poppet valve comprising plug 42, plug spring 44, and plug spring platform 46. Plug 42 is a plug shaped and sized to seal cylinder 22 against fluid passage when retained in place (as shown) by valve spring 44. Valve spring 44 is a low strength spring which extends from plug 42 to plug spring platform 46, and restores plug 42 to a sealing position in the absence of other forces. Plug spring platform 46 includes holes or fluid passages (not shown) to allow fluid to flow through spring platform 46 toward outlet 32. In one embodiment, plug spring platform 46 is threaded to fit into threads in outlet 32. The threaded interior of cylinder 22 also allows threaded tubes and hoses to be attached at outlet 32.

Rotation of cam 12 drives piston 16 back and forth along piston axis PA, as described previously. Straight shaft 18 sometimes blocks port 24, closing port 24 and preventing fluid from exiting cylinder 22 save by outlet 32. While piston 16 moves to the left from its rightmost extension within cylinder 22, valve 25 seals cylinder 22, preventing fluid from exiting seal 22 via outlet 32. The movement of piston 16 creates a partial vacuum between piston face 21 and plug 42 of valve 25. Valve 25 is retained in a seal by seal spring 44, and by vacuum. Movement to the left by piston 16 withdraws straight shaft 18 away from port 24, unblocking and opening port 24 so that fluid can enter cylinder 22. Once port 24 is open, the vacuum is exposed to fluid, which is drawn into cylinder 22 via suction until piston 16 reaches its leftmost position. Piston 16 then travels rightward, expelling fluid through port 24 until port 24 is blocked by straight shaft 18 of piston 16. Continued rightward motion exerts pressure on fluid trapped between piston face 21 and plug 42 of valve 25, opening valve 25. Rightward motion of piston 16 from port 24 to the rightmost extension of piston 16 thus pumps fluid out of cylinder 22 via outlet 32. The total volume of fluid displaced by each cycle of cam 12 and piston 16 is determined by the distance between port 24 and the rightmost extension of straight shaft 18 of piston 16.

Shim clips 38 are inserted between cylinder 22 and base 26, adjusting the position of cylinder 22—and therefore of port 24—relative to cam 12, and the rightmost extension of straight shaft 18. Cylinder 22 is screwed tight, holding shim clips 38 in place. One or more regularly sized shim clips 38 may be inserted to displace cylinder 22 from a default position, flush with base 26. Alternatively, shim clips may 38 may be provided in a variety of thicknesses to adjust the position of cylinder 22 by predetermined amounts. The number and width of shim clips 38 inserted between cylinder 22 and base 26 determines the position of port 24 relative to cam 12. Accordingly, the displacement of pump assembly 10 can be increased or decreased by a known, predetermined amount by removing or adding, respectively, shim clips 38. Shim clips 38 can be added or removed by loosening cylinder 22 without fully withdrawing cylinder 22 from base 26. An O-ring between cylinder 22 and base 26 retains a seal while cylinder 22 is loosened. This allows shim clips 38 to be added or removed while pump assembly 10 contains fluid, without any resulting leakage.

Figure 3:
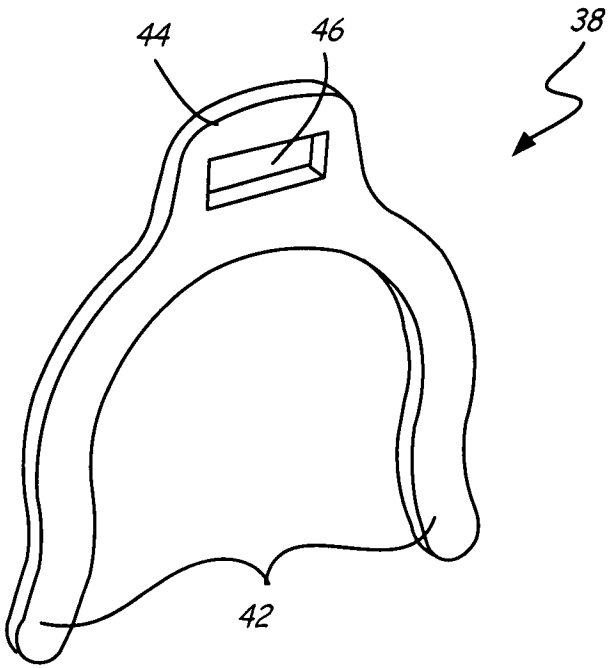
FIG. 3 is a perspective view of a shim clip of the present invention.

FIG. 3 is a perspective view of shim clip 38, including fingers 42, tab 44 and slot 46. Shim clip 38 is a simple piece of rigid material, and may for instance be a piece stamped from sheet metal. Shim clip 38 is shaped to conform to the profile of the exterior of cylinder 22, and includes fingers 42 which enable it to snap onto cylinder 22, so that shim clip 38 will not detach from cylinder 22 before cylinder 22 can be tightened into base 26, thereby securing shims 38 more completely. Fingers 42 hold shim clip in place on cylinder 22 with spring force. Shim clip 38 may include tab 44 for easy insertion or removal, and slot 46 for attaching a lanyard or clamp so that shim clips 38 are not lost while not in use. Slot 46 is also designed to allow insertion of a flat-head screwdriver to remove shim clip 38.

By allowing the position of cylinder 22 to be adjusted relative to cam 12, the present invention enables the displacement of pump assembly 10 to be adjusted without the need for expensive replacement parts, such as replacement cylinders or pistons. The position of cylinder 22 is adjusted by inserting or removing shim clips 38. Shim clips 38 are quickly and easily inserted or removed, and are simple and inexpensive to produce. Additionally, shim clips 38 can be inserted or removed without fully withdrawing cylinder 22, allowing the displacement of pump assembly 10 to be adjusted without leakage, even while fluid is present in pump assembly 10.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A pump assembly comprising:

a base;

a cam which rotates about a rotational axis with respect to the base;

a cylinder which attaches to the base, the cylinder comprising:

an inlet port where fluid enters the cylinder; and an outlet where fluid leaves the cylinder;

a piston reciprocally driven by rotation of the cam to draw fluid into the cylinder through the inlet port during a fill stroke and to close the inlet port and pump the fluid in the cylinder toward the outlet during a pump stroke; and a shim clip removably insertable between the cylinder and the base to increase a distance between the inlet port and the rotational axis, the shim clip comprising fingers which extend around and snap in place about the cylinder to hold the shim clip in place with spring force.

2. The pump assembly of claim 1, wherein inserting the shim clip between the cylinder and the base decreases fluid volume pumped by the pump assembly with each rotation of the cam.

3. The pump assembly of claim 2, wherein inserting the shim clip between the cylinder and the base does not alter a travel distance of the piston.

4. The pump assembly of claim 1, wherein the fluid is grease or oil.

5. The pump assembly of claim 1, wherein the cam is circular and has a geometric center that is displaced from the rotational axis of the cam.

6. The pump assembly of claim 1, wherein the cylinder screws into the base.

7. The pump assembly of claim 6, wherein the cylinder is threaded into the base to anchor the shim clip.

8. The pump assembly of claim 1, wherein the shim clip has a thickness predetermined to decrease the fluid volume pumped by the pump assembly by a known amount.

9. The pump assembly of claim 1, wherein the shim clip comprises a tab for inserting or removing the shim clip between the cylinder and the base.

10. The pump assembly of claim 1, wherein the tab has a rectangular slot which accommodates a flat-head screwdriver tool for removing the shim clip.

11. The pump assembly of claim 1, wherein a plurality of shim clips is inserted between the cylinder and the base, each shim clip contributing a predetermined decrease in fluid volume pumped by the pump assembly with each rotation of the cam.

12. A method for adjusting the fluid displacement of a piston pump comprising a pump base, a cam which rotates with respect to the pump base about a rotational axis, a cylinder fastenable to the pump base and having an inlet and an outlet, and a piston reciprocally movable in the cylinder and driven by the cam, the method comprising:

loosening the cylinder from the pump base, wherein loosening the cylinder does not break a seal between the cylinder and the pump base, thereby avoiding leaking;

inserting or removing a shim clip between the cylinder and the pump base to adjust a distance between the inlet and the rotational axis; and tightening the cylinder on the pump base.

13. The method of claim 12, wherein the pump base and the cylinder are threaded, and loosening and tightening the cylinder comprise unscrewing and screwing the cylinder, respectively.

14. The method of claim 13, wherein the shim clip includes fingers which clip about the cylinder with spring force, such that the shim clip remains in place between the cylinder and the pump base until secured by the tightening of the cylinder on the pump base.

15. The method of claim 12, wherein tightening the cylinder on the pump base holds the shim clip between the cylinder and the pump base.

16. The method of claim 12, wherein inserting a shim clip increases the distance between the rotational axis and the inlet, thereby reducing the fluid volume pumped by the pump assembly with each rotation of the cam.

17. A method for adjusting the fluid displacement of a piston pump comprising a pump base, a cam which rotates with respect to the pump base about a rotational axis, a cylinder fastenable to the pump base and having an inlet and an outlet, and a piston reciprocally movable in the cylinder and driven by the cam, the method comprising:

loosening the cylinder from the pump base;

inserting or removing a shim clip between the cylinder and the pump base to adjust a distance between the inlet and the rotational axis; and tightening the cylinder on the pump base;

wherein the pump base and the cylinder are threaded, and loosening and tightening the cylinder comprise unscrewing and screwing the cylinder, respectively; and wherein the shim clip includes fingers which clip about the cylinder with spring force, such that the shim clip remains in place between the cylinder and the pump base until secured by the tightening of the cylinder on the pump base.

18. The method of claim 17, wherein inserting a shim clip increases the distance between the rotational axis and the inlet, thereby reducing the fluid volume pumped by the pump assembly with each rotation of the cam.

* * * * *